US008893764B2

(12) United States Patent
Mascari et al.

(10) Patent No.: US 8,893,764 B2
(45) Date of Patent: Nov. 25, 2014

(54) OVERHEAD DOOR DECELERATORS AND ASSOCIATED DEVICES, SYSTEMS, AND METHODS

(75) Inventors: Carlo G. Mascari, Milwaukee, WI (US); Milena D. Vohla, Greendale, WI (US)

(73) Assignee: 4Front Engineered Solutions, Inc., Carrollton, TX (US)

( * ) Notice: Subject to any disclaimer, the term of this patent is extended or adjusted under 35 U.S.C. 154(b) by 140 days.

(21) Appl. No.: 13/570,105

(22) Filed: Aug. 8, 2012

(65) Prior Publication Data

US 2014/0041156 A1 Feb. 13, 2014

(51) Int. Cl.
*E05D 13/00* (2006.01)

(52) U.S. Cl.
USPC ..... 160/201; 16/82

(58) Field of Classification Search
CPC ..... E05D 15/165; E05D 13/08; E06B 3/48; E05F 5/003
USPC ..... 160/201, 40, 133; 16/82, 86 R, 86 A, 16/86 B; 292/DIG. 39, DIG. 40, DIG. 15, 292/DIG. 19, DIG. 70, DIG. 36
See application file for complete search history.

(56) References Cited

U.S. PATENT DOCUMENTS

| | | | | |
|---|---|---|---|---|
| 1,787,451 | A | | 1/1931 | Mohun et al. |
| 1,990,870 | A | | 2/1935 | Kelly |
| 2,064,470 | A | | 12/1936 | Heckman |
| 2,090,146 | A | | 8/1937 | Pixley |
| 2,124,969 | A | | 7/1938 | Bagley et al. |
| 2,142,532 | A | * | 1/1939 | Stenersen ..... 401/192 |
| 2,568,477 | A | * | 9/1951 | Westlund ..... 292/288 |
| 2,686,926 | A | | 8/1954 | Schacht, Jr. et al. |
| 2,839,135 | A | | 6/1958 | Anderson |
| 2,846,254 | A | * | 8/1958 | Forest ..... 160/201 |
| 2,929,115 | A | | 3/1960 | Beckstrom |
| 3,140,508 | A | | 7/1964 | Switzgable |
| 3,188,698 | A | | 6/1965 | Zoll et al. |
| 3,336,968 | A | | 8/1967 | Curtis |
| 3,345,677 | A | | 10/1967 | Milette |

(Continued)

FOREIGN PATENT DOCUMENTS

WO WO-2008/045037 4/2008

OTHER PUBLICATIONS

DL Manufacturing cable cop™ Product Description, Copyright © 2009 DL Manufacturing, 2 pages.

(Continued)

*Primary Examiner* — Blair M Johnson
(74) *Attorney, Agent, or Firm* — Perkins Coie LLP

(57) ABSTRACT

Overhead door decelerator assemblies and associated devices, systems, and methods are disclosed herein. In one embodiment, a door assembly includes a door, an elongated door track, and a brush proximate the door track. The door includes a guide member extending outwardly from a side edge portion of the door. The brush is positioned such that moving the door between open and closed positions causes the guide member to deflect a resilient portion (e.g., a plurality of bristles, a plurality of flaps, or a blade) of the brush at regions of the resilient portion consecutively positioned along the length of the brush. The brush can be positioned away from the door when the door is in the closed position and in contact with a portion of the door when the door is in the open position.

23 Claims, 8 Drawing Sheets

(56) References Cited

U.S. PATENT DOCUMENTS 3,484,812 A 12/1969 Holland
3,552,474 A 1/1971 Finnegan
3,628,588 A * 12/1971 Dixon ..... 160/40
3,693,693 A 9/1972 Court
3,928,889 A 12/1975 Wartian
3,934,635 A 1/1976 Kin
4,016,920 A 4/1977 Shepard
D245,266 S 8/1977 Gorse
4,080,757 A 3/1978 Westerman
4,119,133 A 10/1978 Wolf
4,120,072 A 10/1978 Hormann et al.
4,149,295 A 4/1979 Owen
4,155,268 A 5/1979 Lee et al.
4,205,713 A 6/1980 Galbreath
4,352,585 A 10/1982 Spalding
4,379,479 A 4/1983 Whiting
4,452,293 A 6/1984 Gorse
4,467,853 A * 8/1984 Downey, Jr. ..... 160/133
4,478,268 A 10/1984 Palmer et al.
4,572,268 A 2/1986 Wentzel
4,601,320 A 7/1986 Taylor et al.
4,643,239 A 2/1987 Wentzel
4,676,293 A 6/1987 Hanssen
4,776,379 A 10/1988 Kraeutler
4,800,618 A 1/1989 Putz
4,836,589 A 6/1989 Mohr
4,846,245 A 7/1989 Pagliaro et al.
4,880,045 A 11/1989 Stahler
4,894,888 A 1/1990 Bassouls
4,934,835 A 6/1990 Albert et al.
4,957,301 A * 9/1990 Clay et al. ..... 277/345
5,025,847 A 6/1991 Mueller
5,036,899 A 8/1991 Mullet
5,058,651 A 10/1991 Ashley et al.
5,131,450 A 7/1992 Lichy
5,139,075 A 8/1992 Desrochers
5,141,043 A 8/1992 Kraeutler et al.
5,141,044 A 8/1992 Hying et al.
5,163,494 A 11/1992 MacNeil et al.
5,163,495 A 11/1992 Lichy
5,165,746 A 11/1992 Teigen
5,219,015 A 6/1993 Kraeutler et al.
5,222,541 A 6/1993 Hornberger
5,240,216 A 8/1993 Lin et al.
5,246,053 A 9/1993 Kraeutler
5,271,448 A 12/1993 Delgado
5,291,686 A 3/1994 Sears et al.
5,299,617 A 4/1994 Hying et al.
5,307,855 A 5/1994 Martensson, IV
5,351,742 A 10/1994 Lichy
5,353,473 A 10/1994 Sherick
5,353,859 A 10/1994 Oltahfer et al.
5,365,993 A 11/1994 Jella
5,367,825 A 11/1994 Doring et al.
5,368,084 A 11/1994 Hying et al.
5,404,927 A 4/1995 Bailey
5,408,724 A 4/1995 Mullet et al.
5,409,051 A 4/1995 Mullet et al.
5,445,207 A 8/1995 Romanelli et al.
5,447,377 A 9/1995 Baumgartner et al.
5,477,902 A 12/1995 Kraeutler
5,522,446 A 6/1996 Mullet et al.
5,533,561 A 7/1996 Forehand, IV
5,535,805 A 7/1996 Kellogg et al.
5,544,690 A 8/1996 Magro et al.
5,562,141 A 10/1996 Mullet et al.
5,566,740 A 10/1996 Mullet et al.
5,568,672 A 10/1996 Mullet et al.
5,584,333 A 12/1996 Torchetti et al.
5,601,133 A 2/1997 Krupke et al.
5,620,039 A 4/1997 Delgado et al.
5,638,883 A 6/1997 Schulte
5,659,926 A 8/1997 Dietrich
5,718,276 A 2/1998 Rekret
5,718,533 A 2/1998 Mullet et al.
5,720,332 A 2/1998 Nachreiner
5,722,115 A * 3/1998 Arens ..... 16/85
5,727,614 A 3/1998 Lichy
5,737,802 A 4/1998 Jella
5,743,317 A 4/1998 Beringer et al.
5,765,622 A 6/1998 Lichy
5,829,504 A 11/1998 Ekstrand et al.
5,887,385 A 3/1999 Horner et al.
5,927,368 A 7/1999 Rohrer et al.
5,927,862 A 7/1999 Debnam et al.
5,944,086 A 8/1999 Gruben et al.
5,946,869 A 9/1999 Zinbarg
5,954,111 A 9/1999 Ochoa
5,957,187 A 9/1999 Gruben et al.
5,992,497 A 11/1999 Jaehnen et al.
6,035,918 A 3/2000 Kraeutler
6,039,106 A 3/2000 Gontarski et al.
6,041,844 A 3/2000 Kellogg et al.
6,047,761 A 4/2000 Jaehnen et al.
6,068,040 A 5/2000 Magro et al.
6,076,590 A 6/2000 Ford et al.
6,082,430 A 7/2000 Mock
6,089,304 A 7/2000 Mullet et al.
6,089,305 A 7/2000 Gruben et al.
6,094,779 A 8/2000 Young
6,095,229 A 8/2000 Kellogg et al.
6,112,464 A 9/2000 Grisham et al.
6,112,799 A 9/2000 Mullet et al.
6,119,307 A 9/2000 Weishar et al.
6,125,506 A 10/2000 Martin
6,129,130 A * 10/2000 Rekret ..... 160/40
6,148,897 A 11/2000 Horner et al.
6,185,783 B1 2/2001 Carpinella
6,190,751 B1 2/2001 Sylvestor
6,227,281 B1 5/2001 Martin
6,250,360 B1 6/2001 Ochoa
6,263,948 B1 7/2001 Whitley
6,273,175 B1 8/2001 Kellogg et al.
6,279,284 B1 8/2001 Moras
6,315,027 B1 11/2001 Lichy
6,321,822 B1 11/2001 Horner et al.
6,374,567 B1 4/2002 Mullet
6,412,757 B1 * 7/2002 Ohno et al. ..... 267/36.1
6,434,886 B1 8/2002 Johnson et al.
6,463,988 B1 10/2002 Mullet et al.
6,481,487 B2 11/2002 Simon et al.
6,527,035 B2 3/2003 Hoofard et al.
6,536,077 B1 3/2003 Espey
6,540,003 B1 4/2003 Martin
6,554,047 B1 4/2003 Mondragon et al.
6,574,832 B1 6/2003 Boerger et al.
6,588,482 B2 7/2003 Wright
6,598,648 B1 7/2003 Schulte
6,612,357 B1 9/2003 Beringer et al.
6,615,898 B2 9/2003 Schulte
6,640,496 B2 11/2003 Mullet
6,640,872 B1 11/2003 Mullet
6,644,378 B2 11/2003 Mitchell
6,655,442 B2 12/2003 Snyder
6,659,158 B2 12/2003 Laugenbach et al.
6,698,490 B2 3/2004 Hoerner et al.
6,715,236 B2 4/2004 Mullet
6,715,531 B2 4/2004 Simon et al.
6,729,380 B2 5/2004 Whitley et al.
6,739,372 B2 5/2004 Mullet et al.
6,745,814 B2 6/2004 Hoofard et al.
6,792,998 B2 9/2004 David
6,840,300 B2 1/2005 Lewis, Jr.
6,843,300 B2 1/2005 Mullet et al.
6,918,157 B2 7/2005 Koike et al.
6,951,237 B2 10/2005 Mullet
6,964,289 B2 11/2005 Schulte
6,988,528 B2 1/2006 Metz et al.
7,011,347 B2 3/2006 Finardi et al.
7,036,548 B2 5/2006 Johnston et al.
7,055,571 B2 6/2006 Johnston et al.
7,089,990 B2 8/2006 Hormann et al.
7,114,291 B2 10/2006 David
7,114,753 B2 10/2006 Nodorft

(56) References Cited

U.S. PATENT DOCUMENTS

| | | | | |
|---|---|---|---|---|
| 7,117,916 | B2 | 10/2006 | Johnston et al. | |
| 7,128,123 | B2 | 10/2006 | Mullet et al. | |
| 7,721,387 | B1 | 5/2010 | Mullet et al. | |
| 7,861,762 | B2 | 1/2011 | Meichtry | |
| 7,891,400 | B2 | 2/2011 | Meichtry | |
| 8,037,576 | B2 | 10/2011 | Meichtry | |
| 8,490,669 | B2 | 7/2013 | Fletcher et al. | |
| 2005/0205220 | A1* | 9/2005 | Johnston et al. | 160/201 |
| 2009/0044453 | A1 | 2/2009 | Meichtry | |
| 2009/0044454 | A1 | 2/2009 | Meichtry | |
| 2009/0044917 | A1 | 2/2009 | Meichtry | |
| 2010/0319143 | A1 | 12/2010 | Wessel | |
| 2011/0088327 | A1 | 4/2011 | Meichtry | |
| 2014/0041156 | A1* | 2/2014 | Mascari et al. | 16/93 R |

OTHER PUBLICATIONS

DL Manufacturing MxV™ Energy-absorbing Dock Door Product Description, Copyright © 2009 DL Manufacturing, 4 pages.
DL Manufacturing PxV™ Energy-Absorbing Dock Door Product Description, Copyright © 2009 DL Manufacturing, 2 pages.
DL Manufacturing QxV™ Flexible Sectional Dock Door Product Description, Copyright © 2009 DL Manufacturing, 2 pages.
TKO Dock Doors WELTERWEIGHT® Dock Door User's Manual, © 2012 4Front Engineered Solutions, Inc. 15-00015 R9 02/12 WW, 80 pages.
"MpactDoor," Aaron-Bradley Company, 1 page [date unknown].
"MpactDoor—Panel Features and General Specifications," Aaron-Bradley Company Inc., 1 page, published 2008.
Material Handling Engineering, Mar. 1995, "A Door Built to Take the Punches", p. 19.

* cited by examiner

OVERHEAD DOOR DECELERATORS AND ASSOCIATED DEVICES, SYSTEMS, AND METHODS

DOCUMENTS INCORPORATED BY REFERENCE

The following documents are incorporated herein by reference in their entireties: U.S. Pat. No. 8,037,576 (issued Oct. 18, 2011), U.S. Pat. No. 7,891,400 (issued Feb. 22, 2011), U.S. Pat. No. 7,861,762 (issued Jan. 4, 2011), and U.S. patent application Ser. No. 13/398,012 (filed Feb. 16, 2012).

TECHNICAL FIELD

The present technology relates generally to overhead door assemblies. In particular, several embodiments of the present technology are generally directed to components of overhead door assemblies that decelerate and/or capture overhead doors as they move into open and/or closed positions.

BACKGROUND

Overhead doors are commonly used in loading docks, garages, factories, and other settings where large door openings are periodically closed off. Conventional overhead doors typically include a plurality of rectangular door panels pivotally connected along their upper and/or lower edges. Rollers or other guide members can extend outwardly from each side of the door panels, and can be received in corresponding guide channels of door tracks that extend upwardly along each side of the door opening. Some door tracks, often referred to as "vertical lift" door tracks, extend vertically, or at least generally vertically, above the door opening so that the door is retracted into a generally vertical position when opened. Other door tracks, often referred to as "standard lift" or "high lift" door tracks, turn horizontally and extend away from the door opening so that at least a portion of the door is retracted into a generally horizontal position when opened.

Overhead doors can be manually or automatically operated, and typically include a counterbalance mechanism that partially offsets the weight of the door. Automatic overhead doors can include an arm that extends between the door and an operator track parallel to upper portions of the door tracks. A motor and a looped belt or chain can be used to control movement of the arm along the operator track. In this way, movement of the door can be regulated to a slow and steady speed. Some automatic overhead doors can be converted into manual overhead doors, e.g., by disengaging the arm from the belt or chain. Other overhead doors are capable of automatic or manual operation only. Manual overhead doors typically are configured such that an operator can manually lift and lower the door using a handle, a rope, or some other similar mechanism.

In contrast to automatic overhead doors, manual overhead doors are typically more prone to harsh operation leading to more significant wear on components. For example, manual overhead doors may be improperly opened or closed with excessive force. Some overhead door assemblies include an upper bumper that stops the door from moving beyond a fully open position. These upper bumpers can fail due to the impact or mechanical shock associated with forcefully opening the door. Similarly, other portions of overhead door assemblies can fail due to impact or mechanical shock associated with forcefully closing the door, e.g., shock that occurs when the door hits the floor beneath the door opening. Furthermore, in some cases, overhead doors can recoil from fully open and/or fully closed positions after forceful impact, leaving the doors in less desirable partially open or partially closed positions. Overhead doors can also drift down from open positions due to factors other than recoil (e.g., poorly adjusted counterbalance mechanisms).

One conventional approach to reducing mechanical shock and the associated component wear that result from harsh operation of overhead doors includes incorporating raised features (e.g., bumps) in the door tracks. When used with doors including retractable (e.g., spring-loaded) guide members, the raised features can force the guide members to partially retract, thereby absorbing energy and slowing movement of the doors. Retractable guide members are often used in overhead doors to allow the doors to release from the door tracks in response to accidental impact against the door panels. Most overhead doors, however, include non-retractable guide members (e.g., fixed rollers). In some cases, raised features in door tracks are not compatible with overhead doors including non-retractable guide members. Furthermore, repeatedly forcing retractable guide members over raised features can wear down or otherwise damage the guide members over time. Accordingly, there is a need for further innovation in the field of overhead doors, such as new approaches to reducing the negative effects of harsh operation, reducing recoil, reducing drift, and/or addressing other problems stated or not stated herein.

BRIEF DESCRIPTION OF THE DRAWINGS

Many aspects of the present technology can be better understood with reference to the following drawings. The components in the drawings are not necessarily to scale. Instead, emphasis is placed on clearly illustrating principles of the present technology.

In FIG. 1, a door is illustrated in a closed position, and, in FIG. 2, the door is illustrated in an open position.

DETAILED DESCRIPTION

Specific details of several embodiments of overhead door assemblies and associated devices, systems, and methods for decelerating and/or capturing doors are described herein. A person having ordinary skill in the relevant art will understand that the present technology may have additional embodiments, and that the present technology may be practiced without several of the details of the embodiments described herein with reference to FIGS. 1-13. For ease of reference, throughout this disclosure identical reference numbers are used to identify similar or analogous components or features, but the use of the same reference number does not imply that the parts should be construed to be identical. Indeed, in many examples described herein, the identically numbered parts can be distinct in structure and/or function. Furthermore, the same shading is sometimes used to indicate materials in cross section that can be compositionally similar, but the use of the same shading does not imply that the materials should necessarily be construed to be identical.

Figure 1:
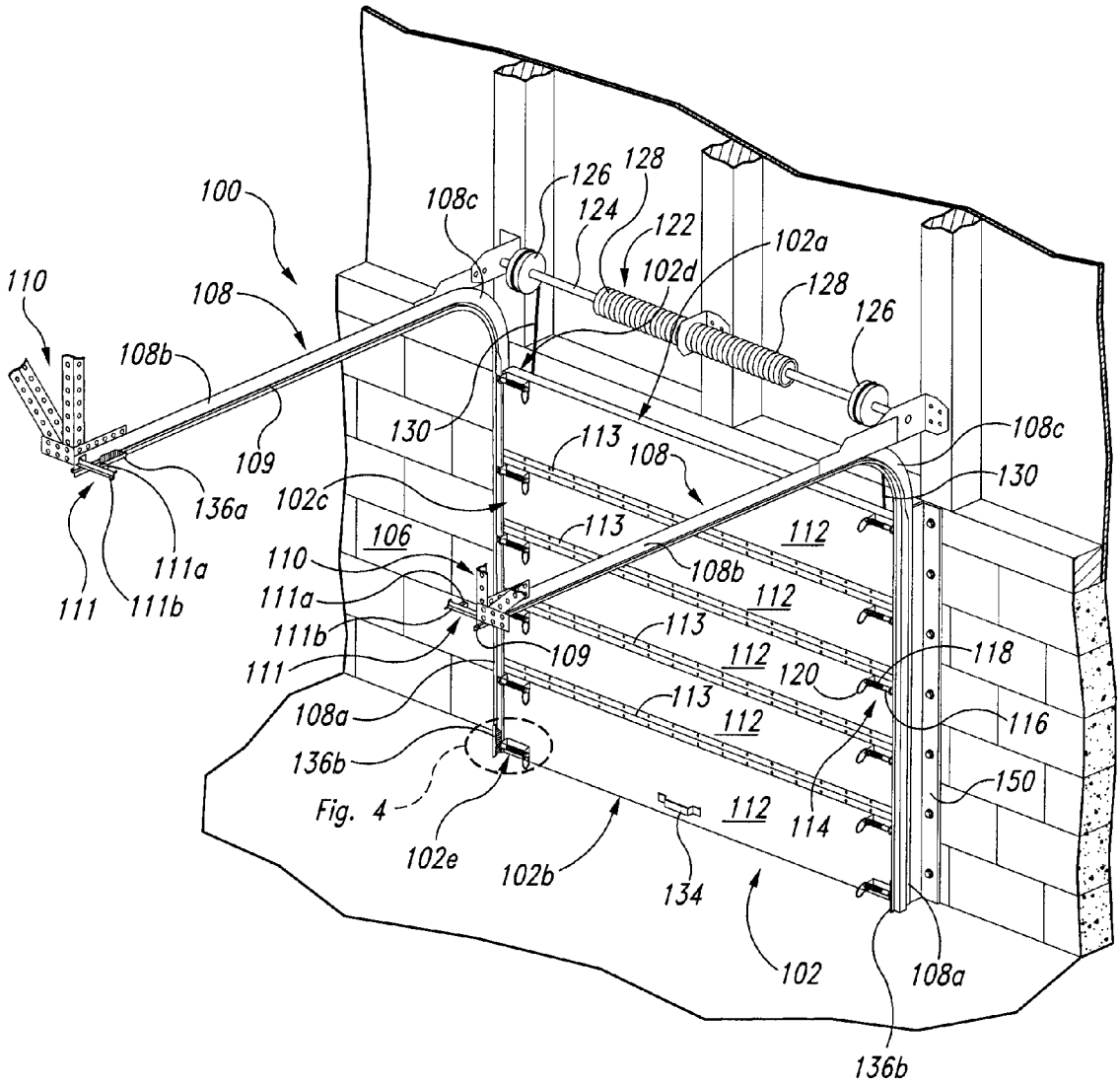
FIGS. 1 and 2 are interior perspective views illustrating an overhead door assembly having one or more door decelerators configured in accordance with embodiments of the present technology.
Figure 2:
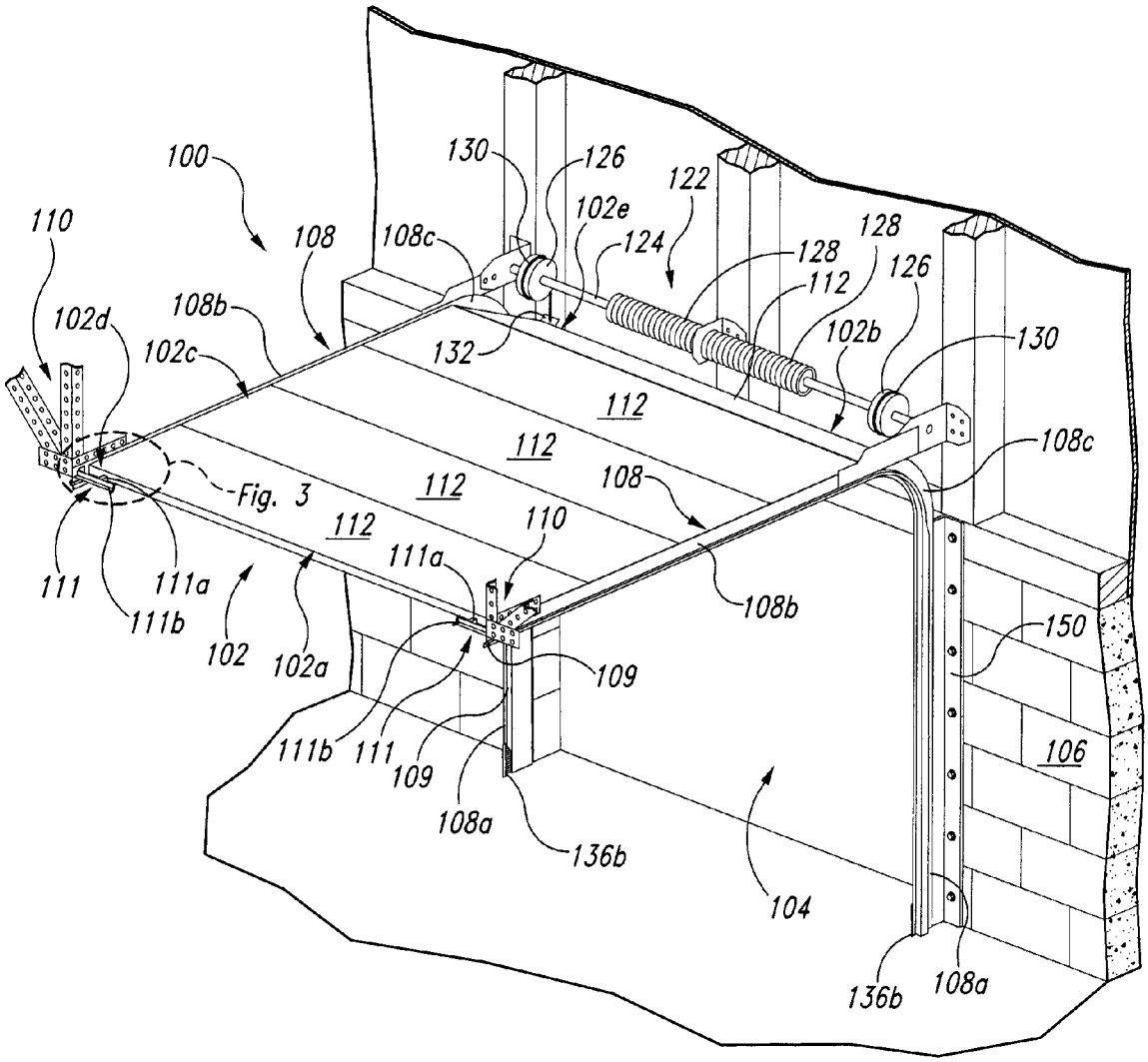

FIGS. 1 and 2 are interior perspective views illustrating an overhead door assembly 100 having one or more door decelerators 136 configured in accordance with embodiments of the present technology. In the illustrated embodiment, the overhead door 102 is illustrated in a closed position and an open position, respectively. With reference to FIGS. 1 and 2 together, the door assembly 100 can be operably installed in a door opening 104 (FIG. 2) in a wall 106 such that the door 102 generally covers the opening 104 when the door 102 is in the closed position (FIG. 1). The door 102 can have an upper edge portion 102*a*, a lower edge portion 102*b*, and two side edge portions 102*c* (one shown in FIGS. 1 and 2) extending between the upper and lower edge portions 102*a*, 102*b*. The door 102 can also have two upper corner portions 102*d* and two lower corner portions 102*e* (one of each shown in FIGS. 1 and 2) where the upper edge portion 102*a* and the lower edge portion 102*b*, respectively, meet the side edge portions 102*c*.

As most clearly shown in FIG. 1, the door assembly 100 can include two elongated door tracks 108 having guide channels 109 with first segments 108*a* attached to the wall 106 proximate sides of the opening 104, second segments 108*b* extending generally horizontally away from the wall 106, and third segments 108*c* between the first and second segments 108*a*, 108*b*. The first segments 108*a* can primarily support the door 102 in the closed position (FIG. 1), while the second segments 108*b* can primarily support the door 102 in the open position (FIG. 2). The third segments 108*c* can be gently curved to facilitate smooth transitional movement of at least a portion of the door 102 between the first and second segments 108*a*, 108*b*. In other embodiments, the third segments 108*c* can be straight or generally straight and the second segments 108*b* can extend vertically, or generally vertically, above the opening 104. In still other embodiments, the third segments 108*c* can be shaped such that at least a portion of the door 102 is at a suitable angle between 0° and 90° from the wall 106 when the door 102 is in the open position.

The door tracks 108 can have a variety of suitable shapes, sizes, materials, and/or other properties. In some embodiments, the guide channels 109 can have different cross sections at the first segments 108*a* than at the second segments 108*b*. For example, the guide channels 109 can have cross sections associated with "knock-out" capability (e.g., as discussed in U.S. Pat. No. 7,861,762) at the first segments 108*a* and cross sections not associated with "knock-out" capability at the second segments 108*b*. In other cases, the guide channels 109 can have the same cross sections (e.g., associated with or not associated with "knock-out" capability) at both the first and second segments 108*a*, 108*b*. As shown in FIGS. 1 and 2, in some embodiments, the door tracks 108 can include sheet metal (e.g., steel or aluminum) or other suitable material bent to define the guide channels 109. In other embodiments, the door tracks 108 can include dense plastic (e.g., ultra-high-molecular-weight polyethylene) or other suitable material molded or machined to define the guide channels 109. Sheet metal, dense plastic, and other suitable materials can be used along all of the door tracks 108 or portions of the door tracks 108. For example, the first and second segments 108*a*, 108*b* can be made of different materials.

With reference again to FIGS. 1 and 2, the door assembly 100 can include overhead supports 110 (e.g., back hangs and/or sway braces) and bumpers 111 proximate end positions of the door tracks 108 furthest from the door opening 104. The overhead supports 110 can be attached to a ceiling (not shown) or another suitable structural element. The bumpers 111 can be configured to prevent the door 102 from moving beyond the open position shown in FIG. 2. In some cases, the bumpers 111 can be configured to absorb mechanical shock resulting from impact with the upper edge portion 102*a* of the door 102. The bumpers 111 can include, for example, one or more resilient structures 111*a* (e.g., rubber pads, coil springs, leaf springs, etc.) mounted on an upper spreader bar 111*b* (partially shown in FIGS. 1 and 2) that extends between the end positions of the door tracks 108 furthest from the door opening 104. In other embodiments, the bumpers 111 can have other suitable portions. For example, the bumpers 111 can be entirely or partially within the guide channels 109.

As shown in FIGS. 1 and 2, the door 102 can include a plurality of panels 112 and a plurality of hinges 113 pivotally coupling the panels 112 together. The door 102 can be configured to bend at the hinges 113 as the panels 112 move past the curved third segments 108*c*. With reference to FIG. 1, the door 102 can include a plurality of guide member assemblies 114 (one identified in FIG. 1) attached to interior sides of the panels 112 proximate the side edge portions 102*c* of the door 102. The guide member assemblies 114 can include guide members 116 (one identified in FIG. 1) extending outwardly from the side edge portions 102*c*. The guide channels 109 can be configured to movably receive the guide members 116 as the door 102 moves between the open and closed positions. In some embodiments, the guide members 116 can be retractable. For example, the guide members 116 can be movable relative to the side edge portions 102*c* between extended positions and ranges of retracted positions. Biasing members 118 (e.g., coil springs, one identified in FIG. 1) of the guide member assemblies 114 can urge the guide members 114 toward the extended positions. The guide member assemblies 114 can further include rings 120 (e.g., rigid rings, loops of cable, or other suitable looped or non-looped pull structures) that can be pulled to manually retract the guide members 116. In other embodiments, the door 102 can have other suitable configurations. For example, the door 102 can include a single panel 112 or a plurality of slats in place of the plurality of panels 112. Furthermore, some or all of the guide members 116 can be non-retractable (e.g., fixed) rather than retractable.

The door assembly 100 can include a counterbalance mechanism 122 having a support rod 124, two cable drums 126 spaced apart on the support rod 124, and one or more torsion springs 128 between the cable drums 126. In other embodiments, the torsion springs 128 can be replaced with weights, leaf springs, or other suitable structures. With reference again to FIGS. 1 and 2, the counterbalance mechanism 122 can further include two cables 130 wound around the cable drums 126 at one end and attached to the door 102 at the opposite end. The cables 130 can be attached to cable brackets 132 (one shown in FIG. 2) proximate the side edge portions 102*c* of the door 102 at an exterior side of the lowermost panel 112. In other embodiments, the cables 130 can be attached to other suitable portions of the door 102. For example, the cables 130 can be attached to the uppermost panel 112 when the door 102 is a vertical-lift door and/or when the counterbalance mechanism 122 is proximate the bumpers 111. As shown in FIG. 1, the door 102 can be configured for manual operation and can include a handle 134 at the interior side of the lowermost panel 112. In other embodiments, the door 102 can be configured for automatic operation or for both manual and automatic operation. Instead of or in addition to the door 102 including the handle 134, the door assembly 100 can include one or more other components useful for manual operation (e.g., a pull rope) and/or one or more components useful for automatic operation (e.g., a motor, an operator track, etc.).

The door assembly 100 can include various features, apparatuses, and/or systems configured to slow movement of the door 102 as the door 102 approaches the open and/or closed positions shown in FIGS. 1 and 2. For example, the door assembly 100 can include one or more (e.g., one or more opposite pairs) of first brushes 136*a* (one shown in FIG. 1) configured to slow movement of the door 102 as the door 102 approaches the open position and/or one or more (e.g., one or more opposite pairs) of second brushes 136*b* configured to slow movement of the door 102 as the door 102 approaches the closed position. In some embodiments, the brushes 136*a*, 136*b* can be attached to or otherwise proximate the door tracks 108 (e.g., opposite end positions of the door tracks 108). The positions of the brushes 136*a*, 136*b* along the door tracks 108 or elsewhere within the overhead door assembly 100 can be selected to reduce and/or dampen the momentum or force with which the upper edge portion 102*c* of the door 102 impacts the bumpers 111 and/or the momentum or force with which the lower edge portion 102*b* of the door 102 impacts the floor beneath the door opening 104 (e.g., without unduly interfering with convenient operation of the door 102).

As shown in FIG. 1, when the door 102 is in the closed position, the first brushes 136*a* can be spaced apart from or otherwise not in contact with the door 102 and the second brushes 136*b* can be in contact with the door 102. Similarly, as shown in FIG. 2, when the door 102 is in the open position, the first brushes 136*a* can be in contact with the door 102 and the second brushes 136*b* can be spaced apart from or otherwise not in contact with the door 102. In some embodiments, the first brushes 136*a* can be configured to interact with the guide members 116 of the guide member assemblies 114 proximate the upper corner portions 102*d* of the door 102, and the second brushes 136*b* can be configured to interact with guide members 116 of the guide member assemblies 114 proximate the lower corner portions 102*e* of the door 102. In these and other embodiments, for example, the first brushes 136*a* can be proximate the bumper 111 and the second brushes 136*b* can be proximate the bottom of the door opening 104. In some cases, such positioning can reduce interaction between the door 102 and the brushes 136*a*, 136*b* other than just before and just after the door 102 reaches the open and/or closed positions.

Figure 3:
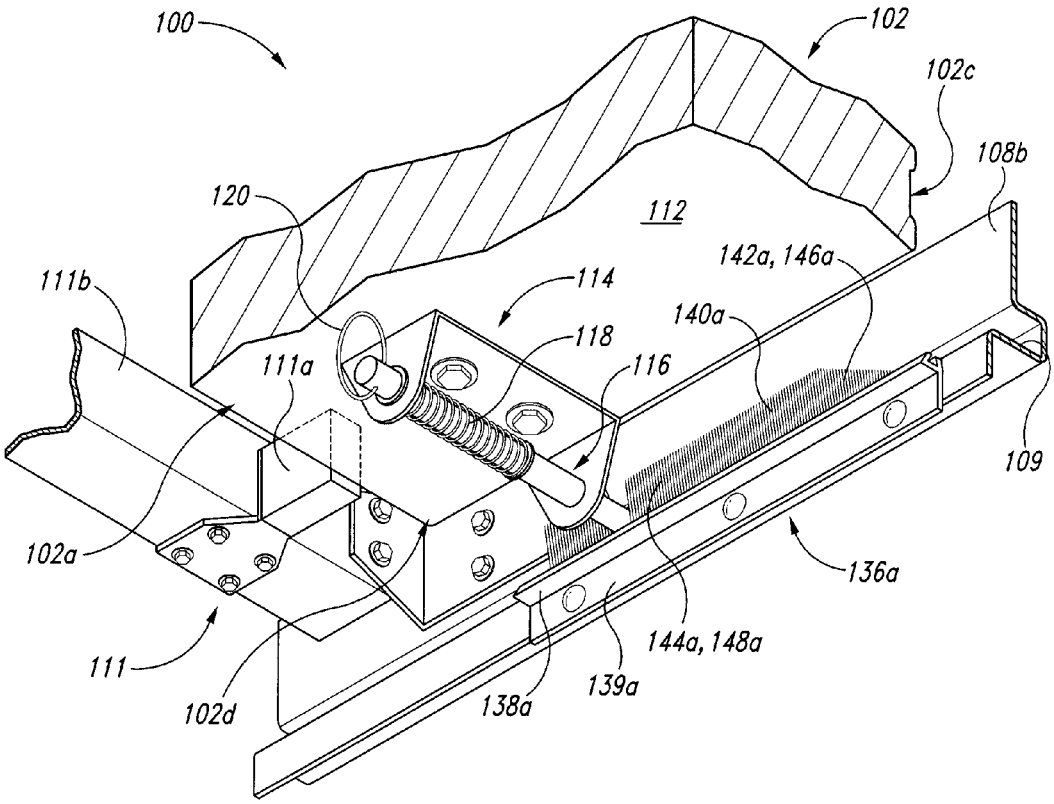
FIG. 3 is an enlarged interior perspective view illustrating a portion of the overhead door assembly shown in FIGS. 1 and 2 including an upper corner portion of the door as viewed from beneath with the door in the open position.
Figure 4:
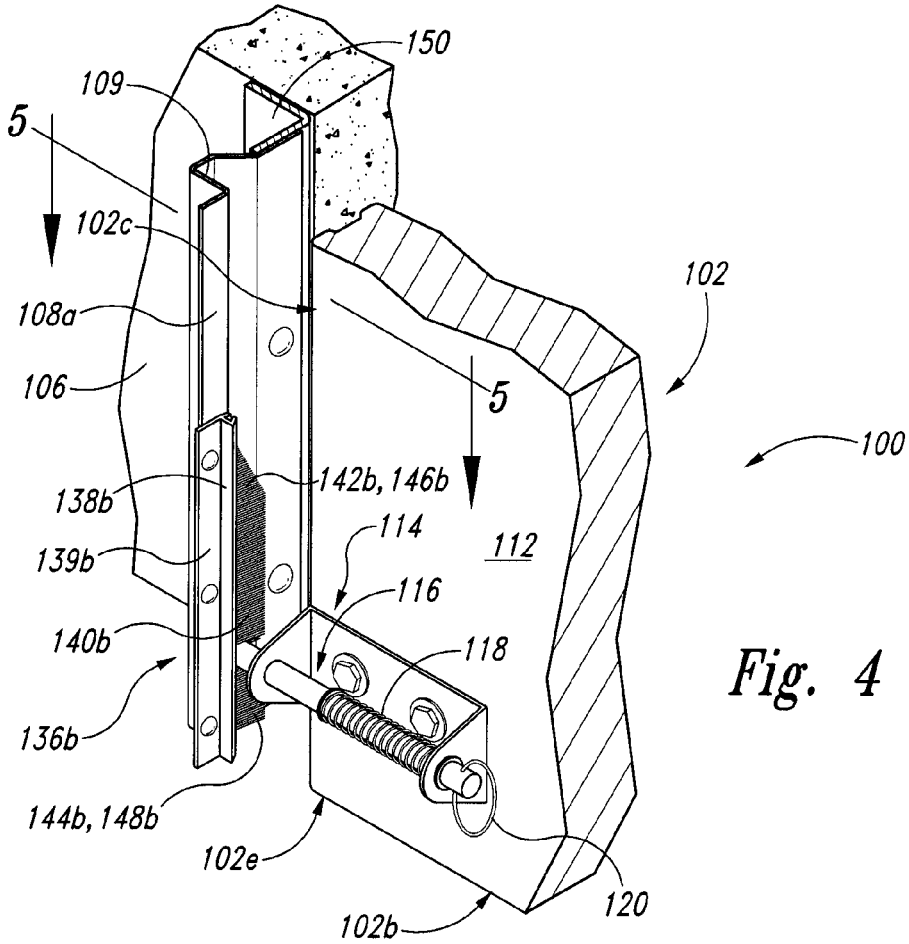
FIG. 4 is an enlarged interior perspective view illustrating a portion of the overhead door assembly shown in FIGS. 1 and 2 including a lower corner portion of the door as viewed from above with the door in the closed position.

FIGS. 3 and 4 are enlarged interior perspective views illustrating, respectively, an upper portion of the overhead door assembly 100 including one of the upper corner portions 102*d* with the door 102 in the open position, and a lower portion of the overhead door assembly 100 including one of the lower corner portions 102*e* with the door 102 in the closed position. Corresponding portions of the overhead door assembly 100 including the upper and lower corner portions 102*d*, 102*e* opposite the upper and lower corner portions 102*d*, 102*e* shown in FIGS. 3 and 4 can be symmetrical to and otherwise generally similar to the portions shown in FIGS. 3 and 4. Furthermore, the first brushes 136*a* (one shown in FIG. 3 and a corresponding first brush 136*a* similarly attached to the opposite door track 108) and the second brushes 136*b* (one shown in FIG. 4 and a corresponding second brush 136*b* similarly attached to the opposite door track 108) can be similarly configured, with each including an elongated base 138*a*, 138*b* and an elongated resilient portion 140*a*, 140*b* attached to and extending from the base 138*a*, 138*b*. The bases 138*a*, 138*b* can include mounting flanges 139*a*, 139*b* configured, respectively, for attachment (e.g., via bolts, screws, and/or other suitable fastening systems) to the second segments 108*b* and the first segments 108*a* of the door tracks 108. The brushes 136*a*, 136*b* can be positioned such that moving the door 102 between the closed position and the open position causes a portion of the door 102 to bend, flex, or otherwise deflect the resilient portions 140*a*, 140*b* (e.g., at regions of the resilient portions 140*a*, 140*b* consecutively positioned along the lengths of the brushes 136*a*, 136*b*). This deflection, alone or in combination with friction between portions of the door 102 and the resilient portions 140*a*, 140*b*, can counteract the momentum or force of the door 102 and thereby decelerate the door 102 before the door 102 reaches the open and/or closed positions.

In some cases, the brushes 136*a*, 136*b* can be configured to reduce or prevent recoil and/or drift of the door 102. For example, the first brushes 136*a* can be configured to capture the door 102 in the open position and/or the second brushes 136*b* can be configured to capture the door 102 in the closed position. In these and other embodiments, the brushes 136*a*, 136*b* can be configured to impart resistance gradually rather than abruptly (e.g., to progressively increase resistance to movement of the door 102 along the door tracks 108). Imparting resistance gradually can facilitate capturing the door 102 when the door 102 approaches the brushes 136*a*, 136*b* at low speed. In such instances, if resistance is imparted too abruptly, the door 102 can stop or recoil before operably engaging the brushes 136*a*, 136*b*. As shown in FIGS. 3 and 4, the resilient portions 140*a*, 140*b* can have first regions 142*a*, 142*b* that the guide members 116 contact first during operation, and adjacent second regions 144*a*, 144*b* consecutively positioned along the lengths of the brushes 136*a*, 136*b*. The second regions 144*a*, 144*b* can have greater resistance to deflecting than the first regions 142*a*, 142*b*. For example, the resilient portions 140*a*, 140*b* can include first pluralities of bristles 146*a*, 146*b* at the first regions 142*a*, 142*b*, and second pluralities of bristles 148*a*, 148*b* at the second regions 144*a*, 144*b*, with the second pluralities of bristles 148*a*, 148*b* having greater average bristle diameter, bristle length, bristle density, bristle stiffness, or combinations thereof, than the first pluralities of bristles 146*a*, 146*b*.

Figure 5:
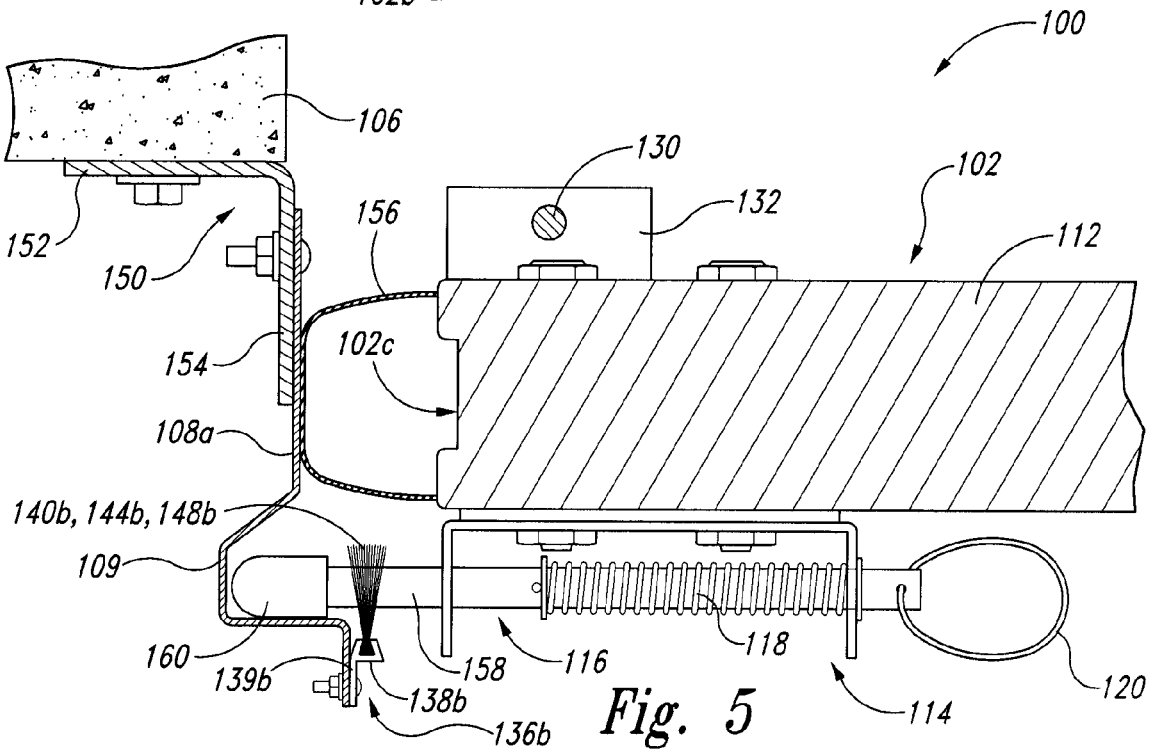
FIG. 5 is a cross-sectional edge view taken along the line 5-5 of FIG. 4 illustrating a portion of the door assembly.

FIG. 5 is a cross-sectional edge view taken along line 5-5 of FIG. 4. As shown in FIG. 5, the door assembly 100 can include mounting brackets 150 having first flanges 152 attached to the wall 106 and second flanges 154 attached to the door tracks 108. In other embodiments, the mounting brackets 150 can be integral with the door tracks 108. The door 102 can include sealing members 156 (e.g., bulb seals) at the side edge portions 102*c*. The sealing members 156 can be compressible and can contact the door tracks 108 between the guide channels 109 and the wall 106. For clarity of illustration, the sealing members 156 are not shown in FIGS. 1-4. With reference to FIG. 5, the guide members 116 can include guide member shafts 158 and head portions 160 at ends of the shafts 158. In some embodiments, the resilient portions 140*a*, 140*b* of the brushes 136*a*, 136*b* can be configured to contact the guide member shafts 158. For example, the resilient portions 140*a*, 140*b* can extend across openings of the guide channels 109, and the shafts 158 can extend through the resilient portions 140*a*, 140*b* to the head portions 160 within the guide channels 109. In other embodiments, the guide members 116 can have other suitable configurations. For example, the guide members 116 can include rollers, wheels, plungers, flanges, conical portions, reverse conical portions, or other suitable structures. Furthermore, the resilient portions 140*a*, 140*b* can be configured to contact portions of the guide members 116 other than the shafts 158. In still further embodiments, the resilient portions 140*a*, 140*b* can be configured to contact other portions of the door 102, such as portions of the door 102 not used to guide movement of the door 102. For example, the resilient portions 140*a*, 140*b* can be configured to contact the sealing members 156, the panels 112, bolts, flanges or other components (not shown) attached to the panels 112, etc.

The brushes 136*a*, 136*b* can have a variety of suitable forms. In some embodiments, the first brushes 136*a* and/or the second brushes 136*b* can have lengths between about 2.0 inches (5.1 centimeters) and about 30 inches (76 centimeters) (e.g., between about 4.0 inches (10 centimeters) and about 16 inches (41 centimeters)). The bristles 146*a*, 146*b*, 148*a*, 148*b* can be made of plastic (e.g., nylon, polyester, etc.), metal (e.g., aluminum, stainless steel, etc.), or other suitable materials. Variables such as material type, brush length, bristle diameter, bristle length, bristle density, and bristle stiffness, can be selected to control the resistance of the brushes 136*a*, 136*b* to movement of the door 102.

Figure 6:
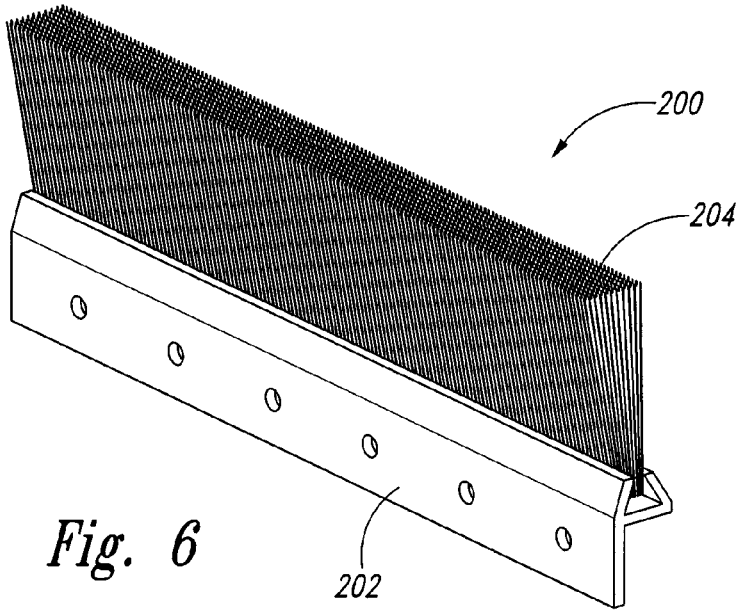
FIGS. 6-8 are perspective views illustrating door decelerators configured in accordance with additional embodiments of the present technology.
Figure 7:
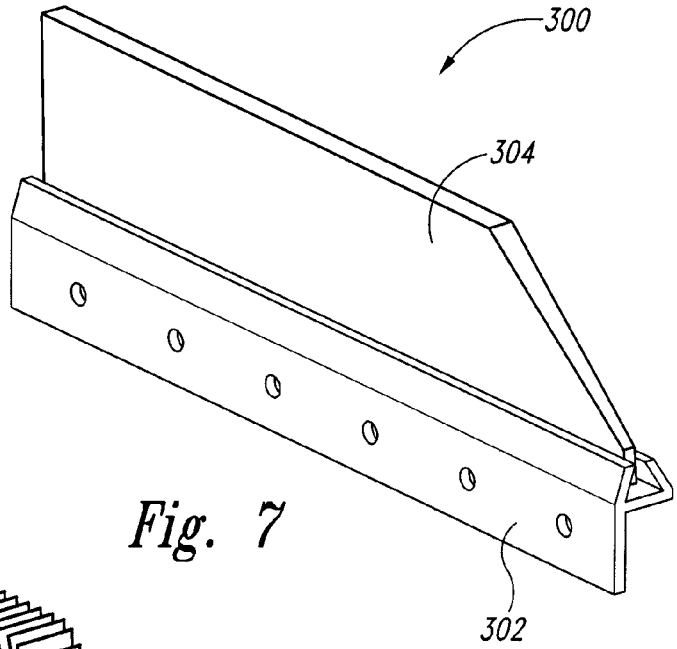
Figure 8:
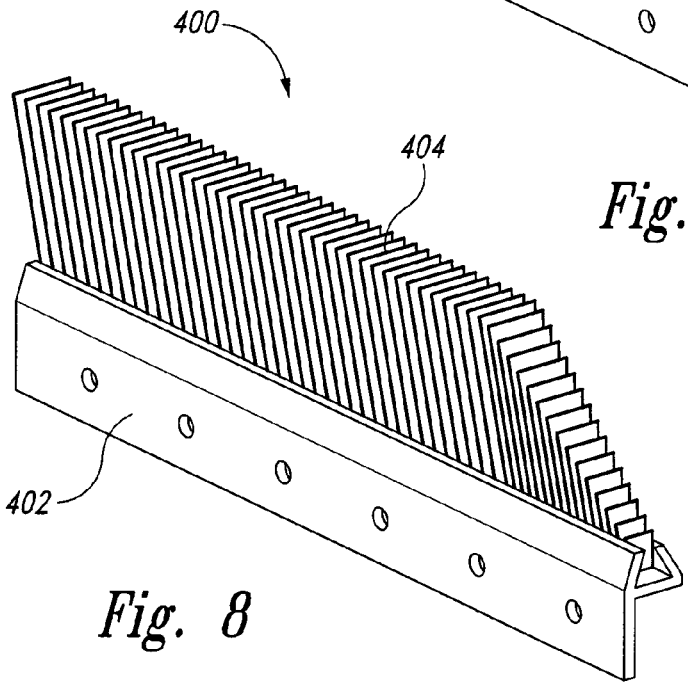

FIGS. 6-8 are perspective views illustrating brushes configured in accordance with additional embodiments of the present technology. As shown in FIG. 6, in one embodiment, a brush 200 can include a base 202 and a plurality of bristles 204 attached to and extending from the base 202 with the bristles 204 all having about the same length. In other embodiments, brushes can have resilient members other than bristles. For example, FIG. 7 illustrates a brush 300 including a base 302 and a resilient blade 304 attached to and extending from the base 302. The blade 304 can be made of rubber, urethane, or another suitable durable resilient material. As another example, FIG. 8 illustrates a brush 400 including a base 402 and a plurality of flaps 404 attached to and extending from the base 402. The flaps 404 can be parallel, as shown in FIG. 8, or can have other suitable arrangements (e.g., random arrangements). Similar to the blade 304 shown in FIG. 7, the flaps 404 shown in FIG. 8 can be made of rubber, urethane, or another suitable durable material.

Figure 9:
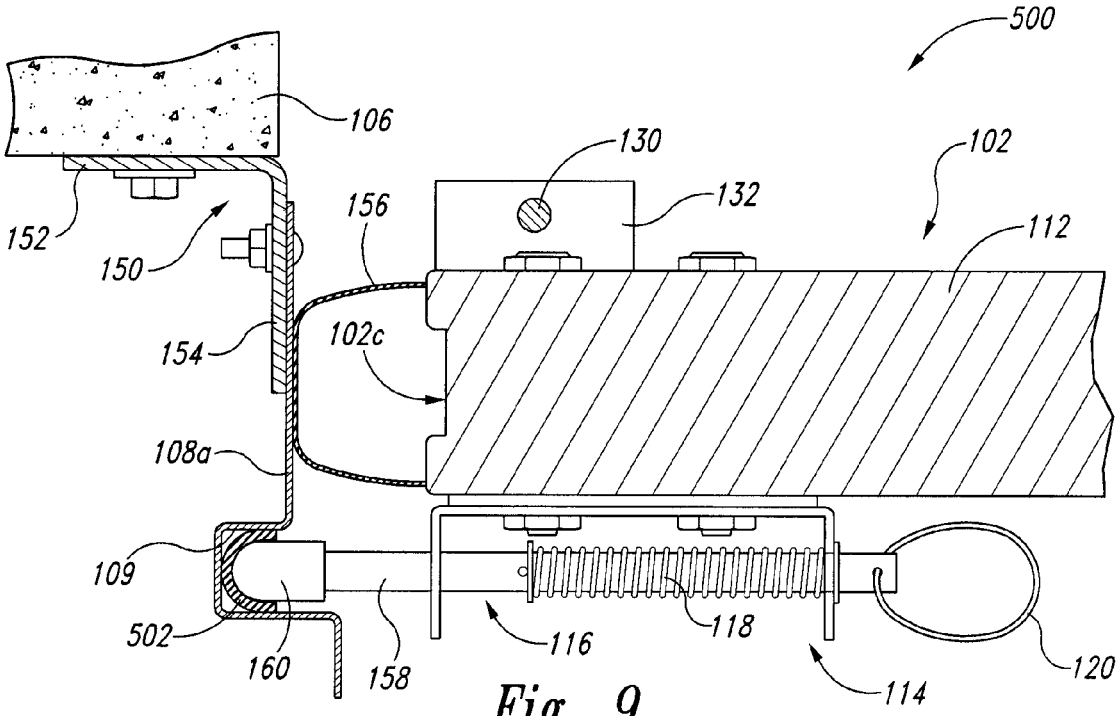
FIGS. 9-10 are cross-sectional edge views illustrating portions of overhead door assemblies having door decelerators configured in accordance with additional embodiments of the present technology.
Figure 10:
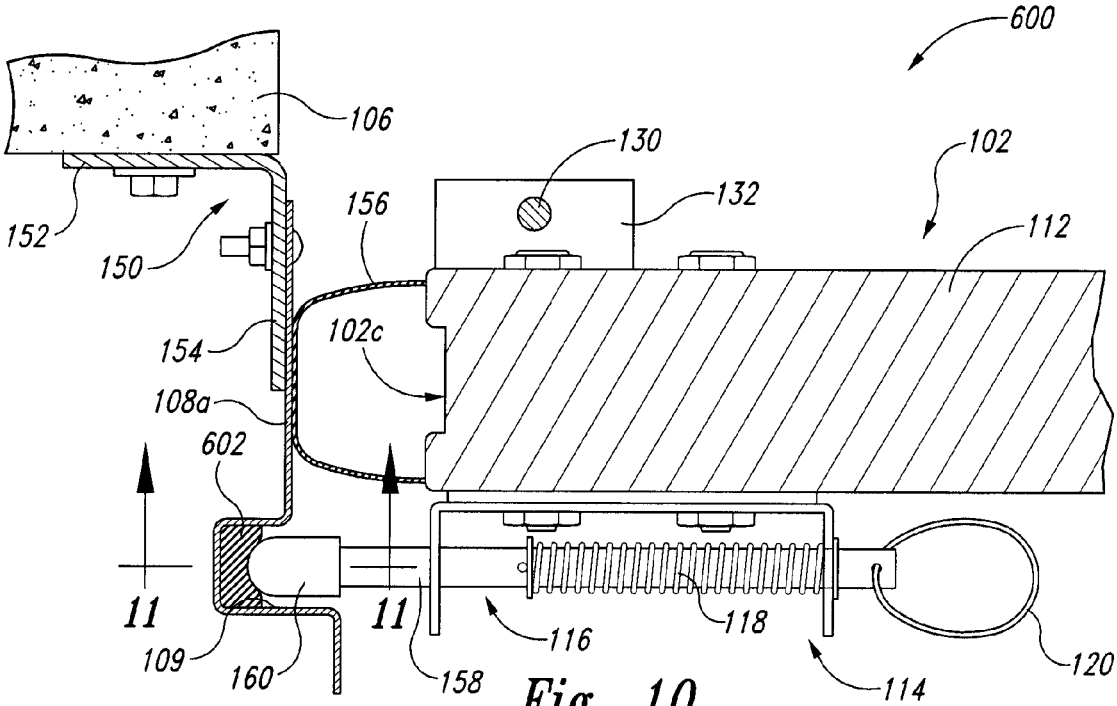

Instead of or in addition to brushes, overhead door assemblies configured in accordance with some embodiments of the present technology can include one or more other types of decelerator devices and/or structures. For example, FIGS. 9 and 10 are cross-sectional edge views illustrating portions of overhead door assemblies including pads 502, 602 that are attached (e.g., glued, bonded, bolted, or otherwise fastened) to the door tracks 109 at least partially within the guide channels 109. The pads 502, 602 can act as decelerators and can be well suited for use with guide members 116 that are retractable. Similar to the brushes 136*a*, 136*b* of the door assembly 100 shown in FIGS. 1-5, the pads 502, 602 can, in some cases, be configured to interact with the uppermost and/or lowermost guide members 116 of the door 102 and can be positioned proximate the bumper (FIGS. 1 and 2) and/or the floor beside the door opening 104 (FIG. 2). When the guide members 116 reach the pads 502, 602, the pads 502, 602 can drive the guide members 116 against the biasing members 118 from extended positions toward retracted positions as the guide members 116 move over the pads 502, 602. Friction between the guide members 116 and the pads 502, 602 can slow and/or capture the door 102.

The shapes, materials, thicknesses, lengths, and/or other properties of the pads 502, 602 can be selected to cause desired levels of resistance to movement of the door 102. For example, when the pads 502, 602 are thicker, they can cause the guide members 116 to retract greater distances and compress against the biasing members 118 with greater force, thereby increasing the force by which the guide members 116 press against the pads 502, 602 and the associated friction. The biasing members 118 can compress in response to predictable levels of force. For example, the biasing members 118 can be configured to compress enough to cause the guide members 116 to retract about 0.20 inch (0.51 centimeter) in response to between about 10 pounds-force (4.5 kilograms-force) and about 45 pounds-force (20 kilograms-force), e.g., between about 20 pounds-force (9.1 kilograms-force) and about 30 pounds-force (14 kilograms-force). Accordingly, the force and corresponding friction between the pads 502, 602 and the guide members 116 can be consistent and predictable. In some embodiments, the coefficients of kinetic friction between the pads 502, 602 and the guide members 116 can be greater than about 0.25, e.g., greater than about 0.4. Suitable materials for the pads 502, 602 include, for example, rubber, polyvinyl chloride, and urethane (e.g., urethane foam), among others. In some embodiments, the pads 502, 602 can include single-ply or multiple-ply conveyor-belt material available, for example, from McMaster-Carr (Elmhurst, Ill.).

The pads 502, 602 can have any suitable levels of compressibility. As shown in FIG. 9, in some embodiments, the pads 502 can have relatively low compressibility (e.g., less than about 5% in response to force from the guide members 116). The pads 502 can be curved or otherwise shaped to at least partially conform to the head portions 160 of the guide members 116. The average thickness of the pads 502 can be, for example, between about 0.10 inch (0.25 centimeter) and about 0.80 inch (2.0 centimeters), e.g., between about 0.20 inch (0.51 centimeter) and about 0.40 inch (1.0 centimeter). As shown in FIG. 10, in other embodiments, the pads 602 can have relatively high compressibility (e.g., greater than about 5%, 10%, or 20% in response to force from the guide members 116). The pads 602 can have generally flat sides facing the guide member 116. The average uncompressed thickness of the pads 602 can be, for example, between about 0.30 inch (0.76 centimeter) and about 1.2 inches (3.0 centimeters), e.g., between about 0.40 inch (1.0 centimeter) and about 0.80 inch (2.0 centimeters). In still further embodiments, the pads 502, 602 can have relatively low compressibility and be curved, have relatively high compressibility and have generally flat sides facing the guide members 116, and/or have other suitable configurations and/or dimensions.

Figure 11:
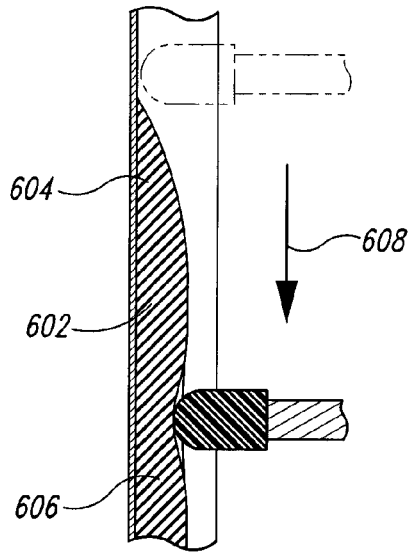
FIG. 11 is a cross-sectional side view taken along line 11-11 of FIG. 10 illustrating a guide member, a pad, and a guide channel.

FIG. 11 is a cross-sectional side view taken along line 11-11 of FIG. 10 illustrating the guide member 116, the pad 602, and the guide channel 109 shown in FIG. 10. Similar to the brushes 136*a*, 136*b* of the door assembly 100 shown in FIGS. 1-5, the pads 502, 602 can be configured to increase resistance gradually rather than abruptly. In some embodiments, the thicknesses of the pads 502, 602 can be tapered along the lengths of the pads 502, 602. For example, in the embodiment illustrated in FIG. 11, the pad 602 can have a first region 604 and a second region 606, with a greater average thickness at the second region 606 than at the first region 604. The pad 602 can be configured to decelerate the door 102 (FIG. 10) as it approaches the closed position, and the pad 602 can be positioned such that moving the door 102 from the open position to the closed position (i.e., in the direction of arrow 608) causes the guide member 116 to contact the first region 604 before the second region 606. Similarly, when the pad 602 is configured to decelerate the door 102 as it approaches the open position, the pad 602 can be positioned such that moving the door 102 from the closed position to the open position causes the guide member 116 to contact the first region 604 before the second region 606.

Figure 12:
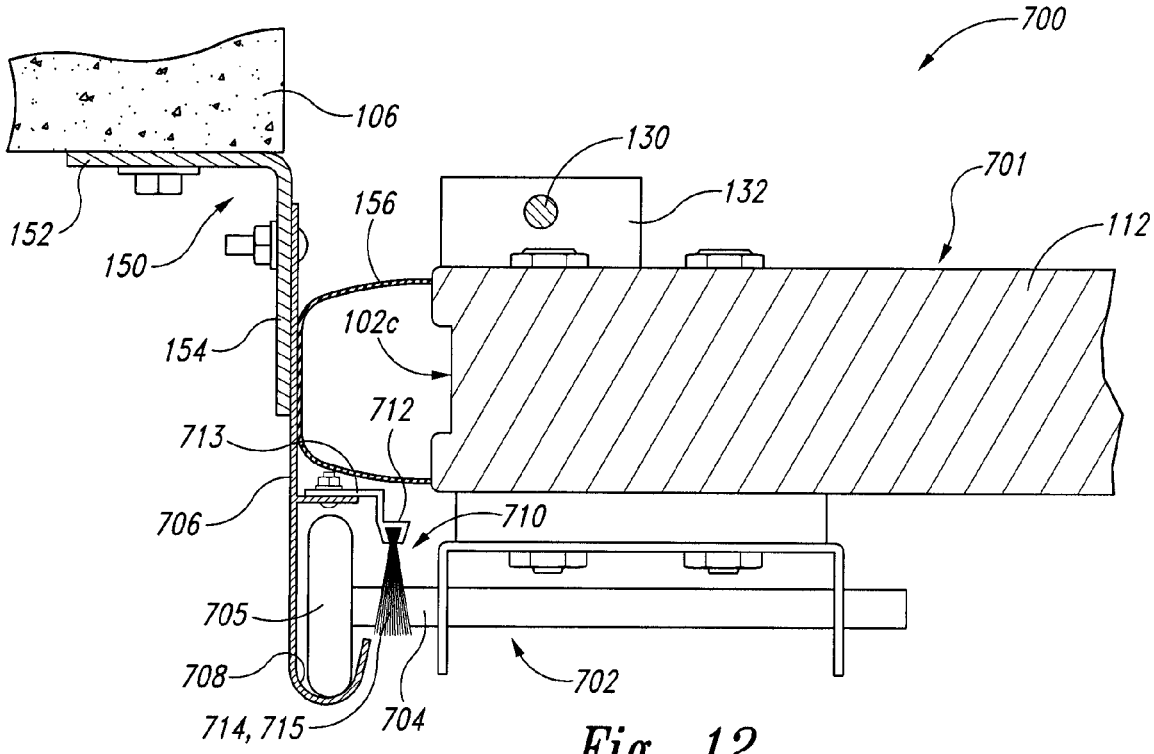
FIG. 12 is a cross-sectional edge view illustrating a portion of an overhead door assembly having a door decelerator configured in accordance with an additional embodiment of the present technology.

Decelerators and other components configured in accordance with embodiments of the present technology can be used with commercial and/or residential overhead doors, including overhead doors with retractable and/or non-retractable guide members. For example, some or all of the retractable guide members 116 shown in FIGS. 1-5 and 9-11 can be replaced with non-retractable (e.g., fixed) guide members. In these and other embodiments, the head portions 160 can be replaced with rollers, which are common particularly in residential overhead doors. FIG. 12 is a cross-sectional view illustrating a portion of an overhead door assembly 700 configured in accordance with an additional embodiment of the present technology having a door 701 with non-retractable guide members 702. The guide members 702 can include guide member shafts 704 and rollers 705 at the ends of the shafts 704. As shown in FIG. 12, the door assembly 700 can further include door tracks 706 having guide channels 708 that are larger than the guide channels 109 shown in FIGS. 1-5 and 9-11 to accommodate the rollers 705. The assembly 700 can further include an elongated brush 710 having an angled base 712 with a mounting flange 713 attached to the door track 706. The brush 710 can also include a resilient portion 714 attached to the base 712. The resilient portion 714 can include a plurality of bristles 715 that extend across an opening of the guide channel 708 such that the shaft 704 contacts the bristles 715 as the door 701 moves between open and closed positions.

Figure 13:
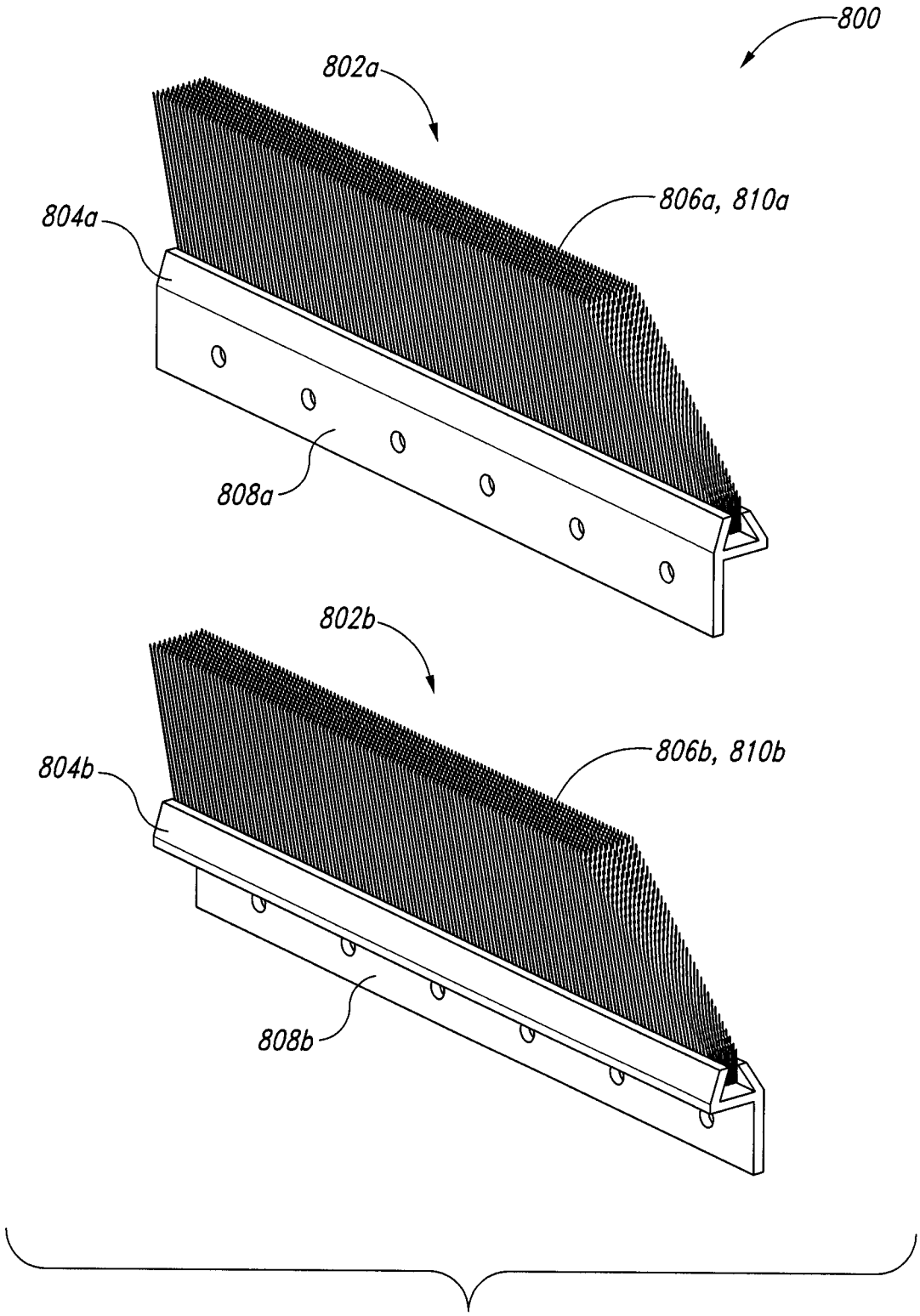
FIG. 13 is a perspective view illustrating a door-decelerator kit configured in accordance with an embodiment of the present technology.

Decelerators and other components configured in accordance with embodiments of the present technology can be fitted or retrofitted to existing overhead door assemblies. For example, a kit configured in accordance with an embodiment of the present technology can include one or more of the brushes 136*a*, 136*b*, 200, 300, 400, 710 and/or pads 502, 602 discussed above along with suitable mounting hardware (e.g., screws, bolts, clamps, adhesive tape, etc.). FIG. 13, for example, is a perspective view illustrating a kit 800 configured in accordance with an embodiment of the present technology. The kit 800 can include an elongated first brush 802*a* and an elongated second brush 802*b* configured for attachment to door tracks (not shown) of an overhead door assembly (not shown). The brushes 802*a*, 802*b* can include bases 804*a*, 804*b* and resilient portions 806*a*, 806*b* attached to the bases 804*a*, 804*b*. The bases 804*a*, 804*b* can include mounting flanges 808*a*, 808*b* offset relative to the resilient portions 806*a*, 806*b*. The resilient portions 806*a*, 806*b* can include pluralities of bristles 810*a*, 810*b* tapered along the lengths of the brushes 802*a*, 802*b*. In some embodiments, the bristles 810*a*, 810*b* can have decreasing length, diameter, density, stiffness, or combinations thereof along the lengths of the brushes 802*a*, 802*b*. As shown in FIG. 13, when the gradations of the bristles 810*a*, 810*b* have generally the same orientation, the offsets of the mounting flanges 808*a*, 808*b* relative to the resilient portions 806*a*, 806*b* can be generally opposite. This can facilitate attachment to door tracks on opposite sides of a door opening.

With reference to FIGS. 1, 2, and 5 together, a method for assembling, fitting, or retrofitting an overhead door assembly in accordance with an embodiment of the present technology can include positioning (e.g., fitting initially or retrofitting) the first brush 136*a* along one of the door tracks 108 (e.g., proximate one of the bumpers 111) such that the resilient portion 140*a* of the first brush 136*a* is out of contact with the door 102 when the door 102 is in the closed position (FIG. 1) and in contact with a portion of the door 102 when the door 102 is in the open position (FIG. 2). The first brush 136*a* can be positioned, for example, such that the portion of the door 102 first contacts the tapered first region 142*a* of the resilient portion 140*a* when the door 102 moves from the closed position to the open position. The mounting flange 139*a* of the base 138*a* of the first brush 136*a* can then be attached to the door track 108. Similarly, instead or in addition to installing the first brush 136*a*, the method can include positioning the second brush 136*b* along the door track 108 (e.g., proximate the floor beside the door opening 104) such that the resilient portion 140*b* of the second brush 136*b* is in contact with a portion of the door 102 when the door 102 is in the closed position and out of contact with the door 102 when the door 102 is in the open position. The second brush 136*b* can be positioned, for example, such that the portion of the door 102 first contacts the tapered first region 142*b* of the resilient portion 140*b* when the door 102 moves from the open position to the closed position. The mounting flange 139*b* of the base 138*b* of the second brush 136*b* can then be attached to the door track 108.

In some cases, methods for assembling, fitting, or retrofitting overhead door assemblies with decelerators in accordance embodiments of the present technology can include one or more stages that can be customized based on the properties of the overhead door. For example, the level of resistance to movement of the door can be decreased for smaller and/or lighter doors or increased for larger and/or heavier doors. The level of resistance to movement of the door can be decreased, for example, by shortening the brushes 136*a*, 136*b* shortening the bristles 146*a*, 146*b*, 148*a*, 148*b* repositioning the brushes 136*a*, 136*b*, and/or other suitable techniques. The level of resistance to movement of the door can be increased, for example, by attaching one or more extensions or additional brushes (not shown) to the door tracks (e.g., proximate the brushes 136*a*, 136*b*), repositioning the brushes 136*a*, 136*b*, and/or other suitable techniques. Such modifications can be made in the field, e.g., incrementally until a desired level of resistance is achieved.

This disclosure is not intended to be exhaustive or to limit the present technology to the precise forms disclosed herein. Although specific embodiments are described herein for illustrative purposes, various equivalent modifications are possible without deviating from the present technology, as those of ordinary skill in the relevant art will recognize. In some cases, well-known structures and functions have not been shown or described in detail to avoid unnecessarily obscuring the description of embodiments of the present technology. Although steps of methods may be presented herein in a particular order, alternative embodiments may perform the steps in a different order. Similarly, certain aspects of the present technology disclosed in the context of particular embodiments can be combined or eliminated in other embodiments. Furthermore, while advantages associated with certain embodiments may have been disclosed in the context of those embodiments, other embodiments can also exhibit such advantages, and not all embodiments need necessarily exhibit such advantages or other advantages disclosed herein to fall within the scope of the present technology. Accordingly, the disclosure and associated technology can encompass other embodiments not expressly shown or described herein.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same feature and/or additional types of other features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

We claim:

1. An overhead door assembly, comprising:

a door;

an elongated door track configured to movably receive a portion of the door as the door moves between open and closed positions; and a brush adjacent to the door track, the brush including a resilient portion tapered along a length of the brush, wherein moving the door between the open and closed positions causes the door to deflect the resilient portion.

2. The door assembly of claim 1 wherein the brush is spaced apart from the door when the door is in the closed position and the brush is in contact with the door when the door is in the open position.

3. The door assembly of claim 1, further comprising a door bumper positioned adjacent an end position of the door track proximate the brush.

4. The door assembly of claim 1 wherein the resilient portion of the brush includes a plurality of bristles,

5. The door assembly of claim 1 wherein the resilient portion of the brush includes a plurality of flaps.

6. The door assembly of claim 1 wherein the resilient portion of the brush includes a blade.

7. The door assembly of claim 1 wherein:

the door further includes a side edge portion and a guide member assembly having a guide member extending outwardly from the side edge portion;

the door track further includes a guide channel configured to movably receive the guide member as the door moves between the open and closed positions; and moving the door between the open and closed positions causes the guide member to deflect the resilient portion of the brush.

8. The door assembly of claim 7 wherein:

the brush further includes an elongated base having a mounting flange; and the resilient portion of the brush extends outwardly from the base and across a portion of the guide channel.

9. The door assembly of claim 7 wherein:

the brush is a first brush and is positioned proximate a first end position of the door track;

the door assembly further comprises a second brush including a resilient portion and positioned proximate a second end position of the door track;

the guide member assembly is a first guide member assembly and is positioned proximate an upper corner portion of the door;

the door further includes a second guide member assembly having a guide member and positioned proximate a lower corner portion of the door;

moving the door between the open and closed positions causes the guide member of the first guide member assembly to deflect the resilient portion of the first brush;

moving the door between the open and closed positions causes the guide member of the second guide member assembly to deflect the resilient portion of the second brush;

the first brush is out of contact with the guide member of the first guide member assembly when the door is in the dosed position and is in contact with the guide member of the first guide member assembly when the door is in the open position; and the second brush is in contact with the guide member of the second guide member assembly when the door is in the closed position and is out of contact with the guide member of the second guide member assembly when the door is in the open position.

10. An overhead door assembly, comprising:

door;

an elongated door track configured to movably receive a portion of the door as the door moves between open and closed positions; and a brush adjacent to the door track, the brush including a resilient portion having a first region and a second region, the second region of the resilient portion having a greater resistance to deflection than the first region of the resilient portion, wherein— moving the door between the open and closed positions causes the door to deflect the resilient portion, and moving the door from the closed position to the open position causes the door to deflect the first region of the resilient portion before deflecting the second region of the resilient portion.

11. The door assembly of claim 10 wherein:

the first region of the resilient portion of the brush includes a first plurality of bristles;

the second region of the resilient portion includes a second plurality of bristles; and the second plurality of bristles has a greater average bristle diameter, bristle length, bristle density, bristle stiffness, or combination thereof than the first plurality of bristles.

12. The door assembly of claim 10 wherein the brush is spaced apart from the door when the door is in the dosed position and the brush is in contact with the door when the door is in the open position.

13. The door assembly of claim 10, further comprising a door bumper positioned adjacent an end position of the door track proximate the brush.

14. The door assembly of claim 10 wherein the resilient portion of the brush includes a plurality of bristles.

15. The door assembly of claim 10 wherein the resilient portion of the brush includes a plurality of flaps.

16. The door assembly of claim 10 wherein the resilient portion of the brush includes a blade.

17. The door assembly of claim 10 wherein:

the door further includes a side edge portion and a guide member assembly having a guide member extending outwardly from the side edge portion;

the door track further includes a guide channel configured to movably receive the guide member as the door moves between the open and closed positions; and moving the door between the open and closed positions causes the guide member to deflect the resilient portion of the brush.

18. The door assembly of claim 17 wherein:

the brush further includes an elongated base having a mounting flange; and the resilient portion of the brush extends outwardly from the base and across a portion of the guide channel.

19. The door assembly of claim 17 wherein:

the brush is a first brush and is positioned proximate a first end position of the door track;

the door assembly further comprises a second brush including a resilient portion and positioned proximate a second end position of the door track;

the guide member assembly is a first guide member assembly and is positioned proximate an upper corner portion of the door;

the door further includes a second guide member assembly having a guide member and positioned proximate a lower corner portion of the door;

moving the door between the open and closed positions causes the guide member of the first guide member assembly to deflect the resilient portion of the first brush;

moving the door between the open and closed positions causes the guide member of the second guide member assembly to deflect the resilient portion of the second brush;

the first brush is out of contact with the guide member of the first guide member assembly when the door is in the closed position and is in contact with the guide member of the first guide member assembly when the door is in the open position; and the second brush is in contact with the guide member of the second guide member assembly when the door is in the closed position and is out of contact with the guide member of the second guide member assembly when the door is in the open position.

20. A method for installing a decelerator of an overhead dorr assembly, the method comprising:

positioning an elongated brush along a door track of an overhead door assembly such that— a resilient portion of the brush is out of contact with a door of the overhead door assembly when the door is in a closed position and in contact with the door when the door is in an open position, and the door first contacts a tapered portion of the resilient portion when the door moves from the closed position to the open position; and mounting the brush to the door track.

21. The method of claim 20, further comprising positioning the brush proximate a door bumper of the overhead door assembly.

22. The method of claim 20 wherein:

the brush is a first brush; and the method further comprises— positioning a second brush along the door track such that a resilient portion of the second brush is in contact with the door when the door is in the closed position and is out of contact with the door when the door is in the open position, and attaching a mounting flange of the second brush to the door track.

23. A method for decelerating an overhead door, the method comprising:

moving an overhead door along a track from an open position toward a closed position;

deflecting a first plurality of bristles of a resilient portion of an elongated brush mounted to the track while moving the overhead door from the open position toward the closed position; and deflecting, after deflecting the first plurality of bristles, a second plurality of bristles of the resilient portion of the elongated brush while moving the overhead door from the open position toward the closed position, wherein the second plurality of bristles has a greater average bristle diameter, bristle length, bristle density, bristle stiffness, or combination thereof than the first plurality of bristles.

* * * * *